US011297935B2

(12) United States Patent
Rundle

(10) Patent No.: US 11,297,935 B2
(45) Date of Patent: Apr. 12, 2022

(54) COLLAPSIBLE TABLE

(71) Applicant: Craster Ltd., London (GB)

(72) Inventor: Tim Rundle, London (GB)

(73) Assignee: Craster Ltd., London (GB)

( * ) Notice: Subject to any disclaimer, the term of this patent is extended or adjusted under 35 U.S.C. 154(b) by 0 days.

(21) Appl. No.: 16/095,296

(22) PCT Filed: Mar. 24, 2017

(86) PCT No.: PCT/GB2017/050846
§ 371 (c)(1),
(2) Date: Oct. 19, 2018

(87) PCT Pub. No.: WO2017/182769
PCT Pub. Date: Oct. 26, 2017

(65) Prior Publication Data

US 2019/0090625 A1 Mar. 28, 2019

(30) Foreign Application Priority Data

Apr. 21, 2016 (GB) ..... 1606967

(51) Int. Cl.
*A47B 3/00* (2006.01)
*A47B 3/08* (2006.01)
(Continued)

(52) U.S. Cl.
CPC ..... *A47B 3/002* (2013.01); *A47B 3/0803* (2013.01); *A47B 3/12* (2013.01); *A47B 3/06* (2013.01); *A47B 2200/0013* (2013.01)

(58) Field of Classification Search
CPC ..... A47B 3/002; A47B 3/12; A47B 3/0803; A47B 3/06
See application file for complete search history.

(56) References Cited

U.S. PATENT DOCUMENTS 1,668,282 A * 5/1928 Moore ..... A61G 21/00 248/167
1,800,685 A 4/1931 Griffis
(Continued)

FOREIGN PATENT DOCUMENTS

CN 202653486 6/2012
CN 104490096 A 4/2015
(Continued)

OTHER PUBLICATIONS

World Intellectual Property Office, International Search Report received for International Application No. PCT/GB2017/050846, dated Jul. 18, 2017, 2 pages.

*Primary Examiner* — Daniel J Rohrhoff
(74) *Attorney, Agent, or Firm* — SoCal IP Law Group LLP; Mark Andrew Goldstein

(57) ABSTRACT

A collapsible table (100) comprising: a central strut (106); at least three legs (112) in communication with the central strut (106); and a table top (104) supportable by the central strut (106) and legs (112); wherein a plurality of the legs (112) are pivotally connected to the central strut (106); the collapsible table (100) having a first state and a second state wherein, in the first state, each pivotally connected leg (112) is pivotally extended for supporting the table top (104) perpendicular to the legs (112) and in the second state the pivotally connected legs (112) are pivotally retracted such that each pivotally connected leg (112) is closer to parallel with the central strut (106), the table top (104) fitting within a space (124) defined on three sides by the central strut (106) and legs (112).

15 Claims, 3 Drawing Sheets

(51) Int. Cl.
*A47B 3/12* (2006.01)
*A47B 3/06* (2006.01)

(56) References Cited

U.S. PATENT DOCUMENTS

| | | | | | |
|---|---|---|---|---|---|
| 3,188,158 | A * | 6/1965 | Moore | A47B 3/002 | 312/277 |
| 4,974,526 | A * | 12/1990 | Wiygul, Jr. | A47B 3/002 | 108/157.1 |
| 5,205,223 | A * | 4/1993 | Ball | A47B 3/0803 | 108/115 |
| 5,775,233 | A * | 7/1998 | Kendall | F16M 11/38 | 108/115 |
| 6,041,723 | A | 3/2000 | Graham | | |
| 6,164,217 | A * | 12/2000 | Prendergast | A47B 3/00 | 108/115 |
| 6,845,723 | B2 * | 1/2005 | Kottman | A47B 3/00 | 108/115 |
| 8,091,488 | B2 * | 1/2012 | Chirea | A47B 7/02 | 108/115 |
| 9,950,728 | B2 * | 4/2018 | Weiser | A47B 3/0803 | |
| 2009/0301361 | A1 * | 12/2009 | Hsieh | A47B 3/002 | 108/129 |
| 2011/0036277 | A1 * | 2/2011 | Prendergast | A47B 3/00 | 108/50.11 |
| 2012/0048157 | A1 | 3/2012 | Hsieh | | |
| 2018/0235359 | A1 * | 8/2018 | Reinhart | A47B 3/12 | |
| 2019/0098992 | A1 * | 4/2019 | Scott | A47B 13/06 | |

FOREIGN PATENT DOCUMENTS

| | | | | |
|---|---|---|---|---|
| CS | 198844 | B1 | 6/1980 | |
| DE | 10061926 | A1 | 6/2002 | |
| EP | 1772084 | | 10/2006 | |
| EP | 1772084 | A2 | 4/2007 | |
| GB | 1041489 | A | 9/1966 | |
| GB | 2059255 | A | 4/1981 | |
| KR | 20210120487 | A * | 10/2021 | A47B 13/021 |
| WO | 9824342 | A1 | 6/1998 | |
| WO | 2009030911 | A1 | 3/2009 | |
| WO | 2017182769 | A1 | 10/2017 | |

* cited by examiner

COLLAPSIBLE TABLE

RELATED APPLICATION INFORMATION

This patent claims priority from International PCT Patent Application No. PCT/GB2017/050846, filed Mar. 24, 2017 entitled, "COLLAPSIBLE TABLE", which claims priority to Great Britain Patent Application No. 1606967.6, filed Apr. 21, 2016 all of which are incorporated herein by reference in their entirety.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

The present invention relates to a collapsible table.

It is well known to provide furniture with the ability to be used for a period and then packed away such that it takes up a smaller amount of space in storage. Especially popular are collapsible chairs and tables which can be assembled, for example, when visitors are present, or in other situations where furniture is required in addition to usual levels.

In many cases, such furniture is lightweight and may not be particularly sturdy, due to the need to provide a frame for the furniture which is easily capable of being folded. In other cases, where the furniture is more substantial, it may not be able to collapse to the desired degree. It is therefore desirable to provide collapsible furniture which is both sturdy and is able to collapse such that it has a small total volume.

SUMMARY

In accordance with a first aspect of the invention, there is provided a collapsible table comprising: a central strut; at least three legs in communication with the central strut; and a table top supportable by the central strut and legs; wherein a plurality of the legs are pivotally connected to the central strut; the collapsible table having a first state and a second state wherein, in the first state the pivotally connected legs are pivotally extended for supporting the table top perpendicular to the legs and in the second state the pivotally connected legs are pivotally retracted such that each pivotally connected leg is parallel to the central strut, the table top fitting within a space defined on three sides by the central strut and legs.

Preferably, a pair of legs may be pivotally connected at or adjacent to a first end of the central strut. In addition, a second pair of legs may be pivotally connected at or adjacent to a second end of the central strut.

Each pair of legs may pivot about a common axis. The pivotal connection of each pivotally connected leg may allow rotation through an angle of at least 20 degrees, at least 30 degrees, or at least 45 degrees.

In a beneficial arrangement, the space may be bounded by the central strut and at least one of the legs, preferably all of the pivoting legs. The space may be bounded by a line joining two ground-contacting ends of the legs, typically of legs attached to opposing ends of the central strut. However, the space may be bounded by a line joining points representing the extension of the legs beyond two ground-contacting ends of the legs by not more than 10% or 5% or 2.5% of the length of the legs from the central strut. As such, the table top may protrude slightly, but not largely, from between the legs.

Preferably, each pivotally connected leg may be connected to the central strut by a hinge. The hinge may be a barrel hinge.

Each pivotally connected leg may have a thickness equal to or less than 50% of the thickness of the central strut.

In one arrangement, each pivotally connected leg may have a first portion which pivotally extends in a common plane with the central strut and a second portion which extends in a direction perpendicular to the common plane.

The table top may be releasably attachable to the central strut and/or legs, in the first state. In one such arrangement, the table top may be releasably attachable by way of at last one protrusion receivable in at least one corresponding depression, each protrusion being located on one of an underside of the table top and an upper side of the central strut or legs, each corresponding depression being located on the other of the underside of the table top and the upper side of the central strut or legs. One or more of the protrusions and/or depressions may be located at or adjacent to an outermost extent of each leg. Each protrusion and depression may interlock, and may have a first state in which they can be released and a second state in which they are interlocked so that they can only be released by first transitioning to the first state. The transition between first and second states may require relative movement of the table top and the central strut and/or legs, typically in a direction different to that required to remove the protrusion from the depression in the first state.

Optionally, the table top may be formed as one piece, the thickness of the table top being less than or equal to the thickness of the central strut. Alternatively, the table top may be foldable, the thickness of the table top in a folded state being less than or equal to the thickness of the central strut.

In the second state, the table top may be within the space.

In accordance with a second aspect of the invention, there is provided a method of collapsing a table such that it occupies a smaller volume, the method comprising: providing a collapsible table having a central strut, at least three legs in communication with the central strut; and a table top supportable by the central strut and legs, wherein a plurality of the legs are pivotally connected to the central strut; removing the table top from the table; retracting the pivotally connected legs such that they are parallel to the central strut; placing the table top within a space defined on three sides by the central strut and legs.

The table may be in accordance with the first aspect of the invention.

DETAILED DESCRIPTION

Figure 1:
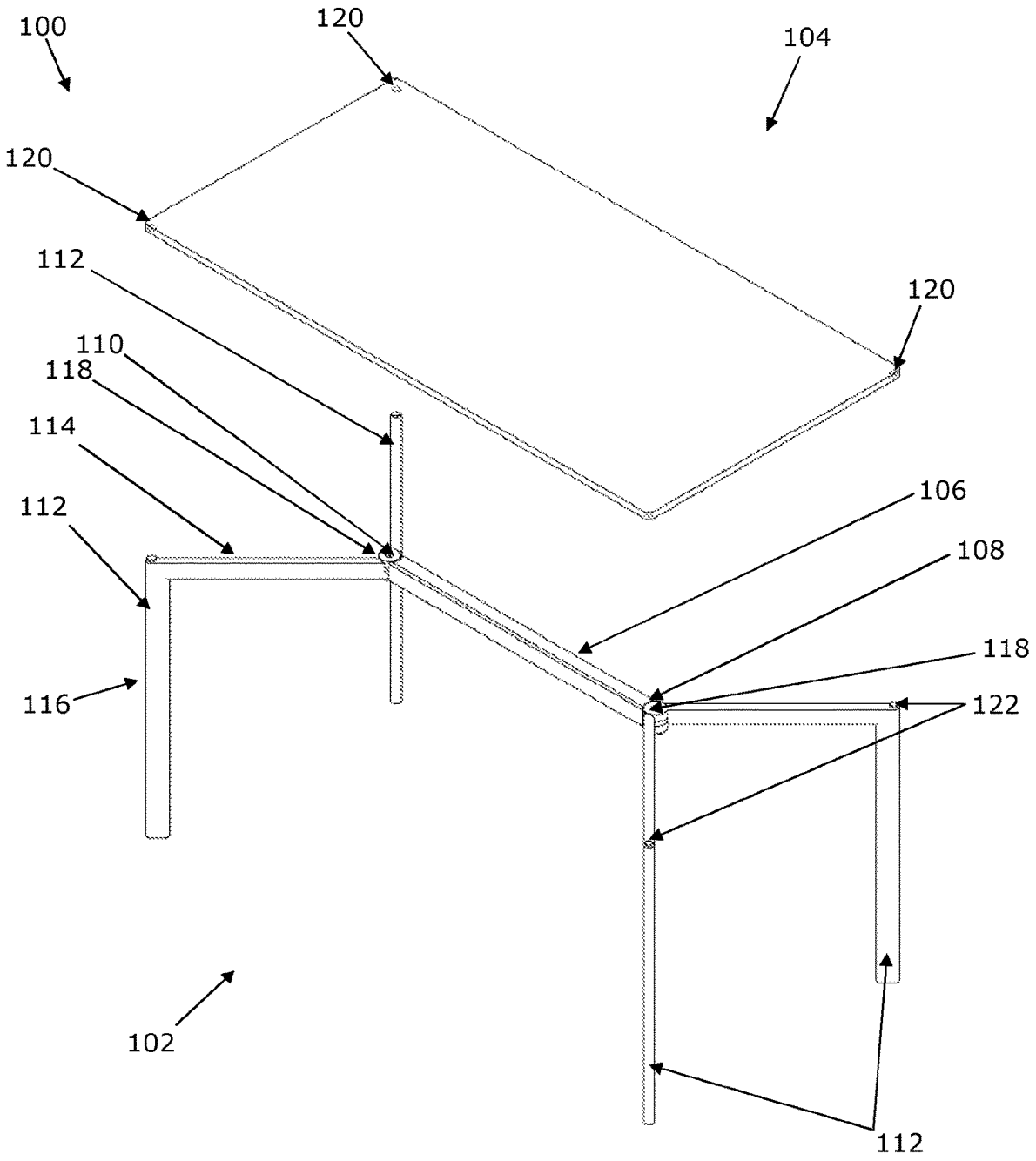
FIG. 1 depicts an exploded view of a collapsible table in accordance with the first aspect of the invention.

Referring to FIGS. 1 to 4, there is shown a table 100 comprising a frame 102 and a table top 104. The frame includes a central strut 106 having first and second ends 108, 110. The central strut 106 is linear and has constant rectangular cross-section along the majority of its length, although it is also possible to provide it having square, triangular, or other, more complex, cross-sections, which may vary along the length of the central strut 106.

Four legs 112 are disposed around the central strut 106, arranged such that two legs 112 are at each of the first and second ends 108, 110. Each leg 112 includes a first portion 114 which extends away from, and is coplanar with, the central strut 106, and a second portion 116 which extends in a direction perpendicular to the first portion 114, extending towards the ground, in use.

Each leg 112 is connected via a pivot point 118 which enables the leg 112 to rotate through a range of motion. In the present embodiment, each pair of legs 112 pivots about a common axis, the two common axes being perpendicular to a longitudinal axis of the central strut 106. A central axis of each leg 112 is slightly offset from its respective common axis such that each leg 112 of the pair is capable of adopting a position parallel or substantially parallel to that of the other leg 112 of the pair. Importantly, each leg 112 is simultaneously capable of being parallel to the longitudinal extent of the central strut 106. In the depicted embodiment each leg 112 is capable of rotating through an arc of at least 90 degrees, and potentially 180 degrees, due to the construction of the pivot point 118, which is a double-sided barrel hinge. Other types of hinge which allow, at a minimum, for the legs 112 of each pair of legs 112 to be capable of being parallel to one another may also be used, if desired.

Figure 2:
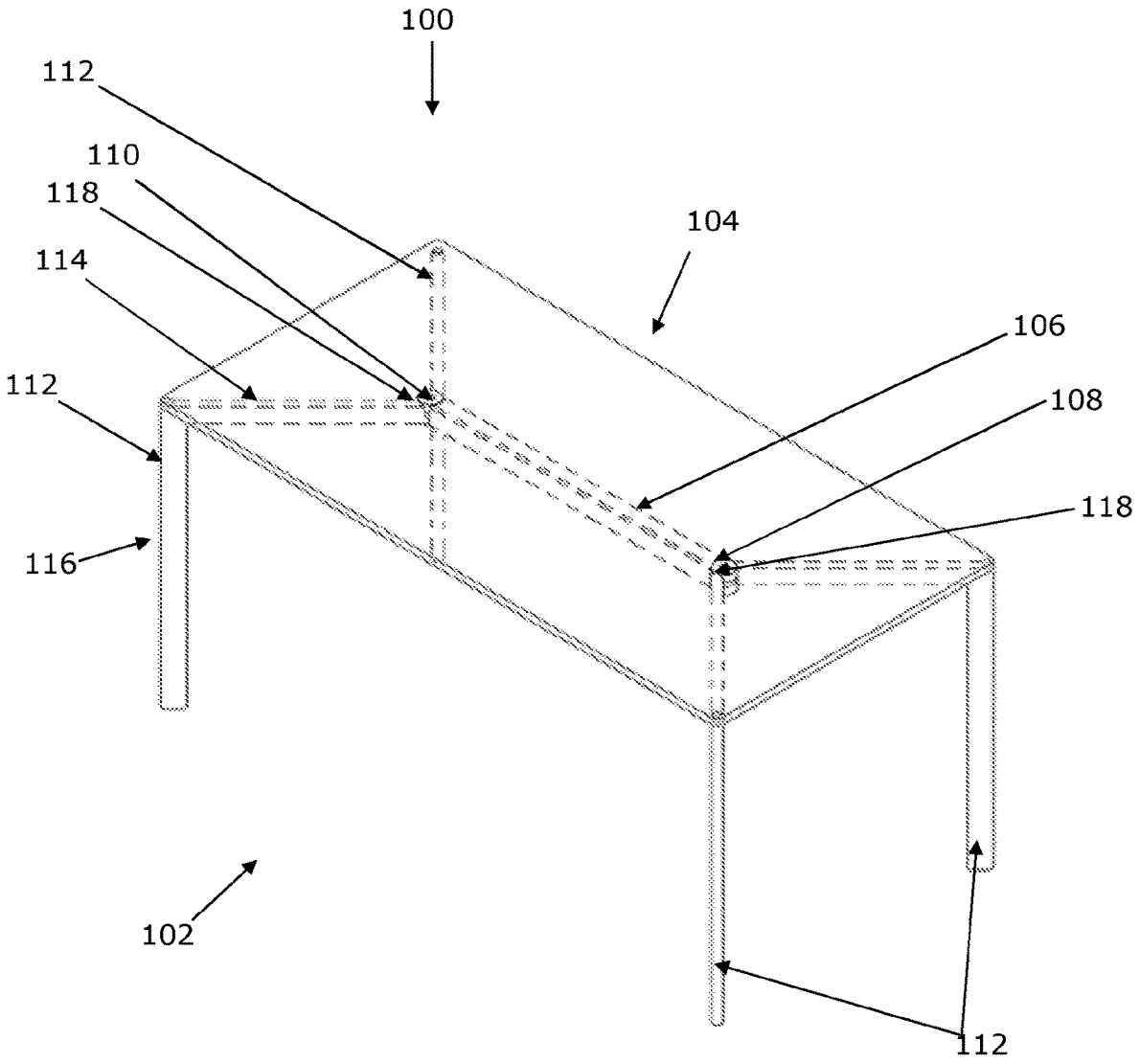
FIG. 2 depicts the table of FIG. 1, in the first state.

FIGS. 1 and 2 show the table 100 in a first state, or assembled state, in which each leg 112 of each pair of legs 112 is separated from the other of the pair, in order that the frame 102 is free-standing. In the Figures, there is an approximate angle of 90 degrees between the legs 112, each leg 112 being approximately 45 degrees from the longitudinal axis of the central strut 106. The total separation of the legs 112 may be chosen from any angle which is suitable for supporting the table top 104 in a preferred position.

With the frame 102 of the table 100 in the first state, the table top 104 can be attached. The table top 104 comprises a cuboid with width and length much greater than its thickness. As shown, the table top 104 is aligned in position by way of a series of four depressions 120, one depression 120 being located towards each corner of the table top 104. Each depression 120 corresponds to a complimentarily-shaped protrusion 122 at or adjacent to the outermost point of the first portion 114 of each leg 112. The depressions 120 fit onto the protrusions 122, locating the table top 104 in the correct position and simultaneously rotationally fixing the legs 112, ensuring that the table 100 is sufficiently sturdy.

Fixings or preset positions on each pivot point 118 may allow the legs 112 to be fixed in position without the table top 104 being in position. This could beneficially allow a user to ensure that the legs 112 are in the correct position for assembly before they attempt to attach the table top 104. Alternatively, if no fixings are required, it may also be possible to have no fixings for the legs 112 or means of locating the table top 104, instead relying solely on the weight of the table top 104 to keep it in position. In addition, the fixing or positioning means may be situated only on a portion of the structure, such as on the central strut 106 or on the legs 112 and may fix or position in only one location or in multiple locations.

Figure 3:
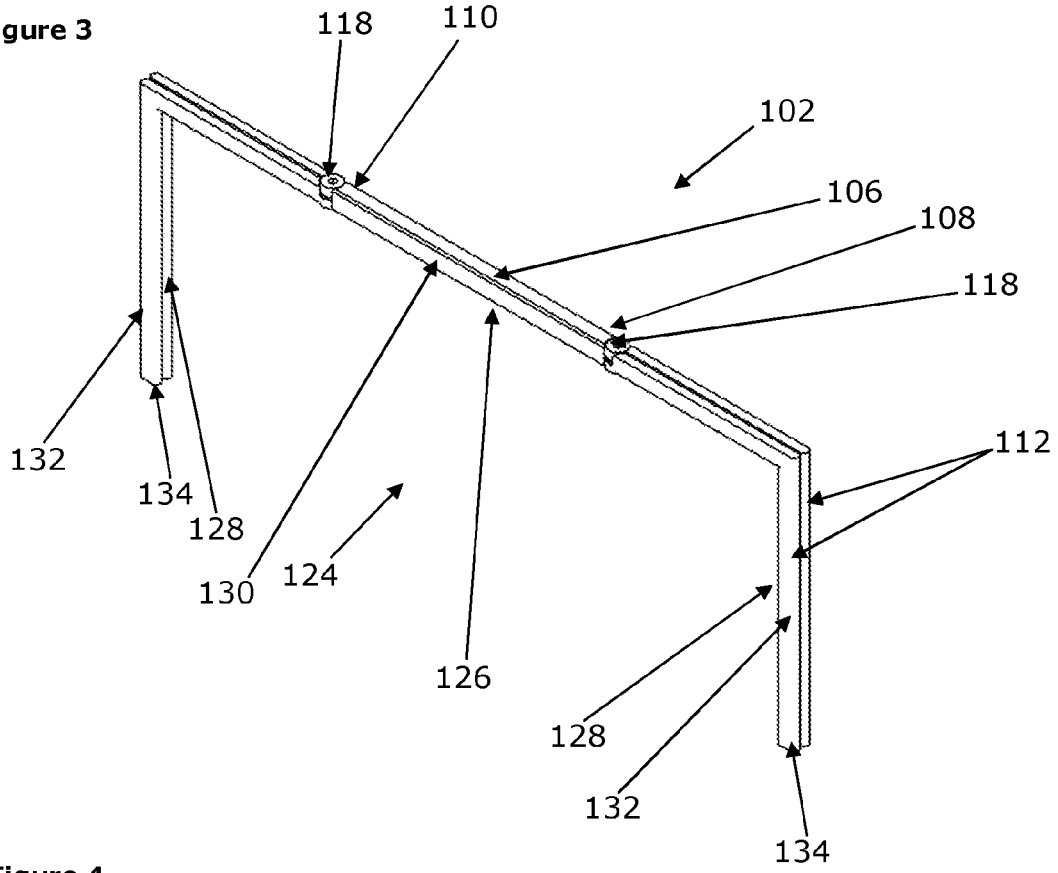
FIG. 3 depicts the central strut and legs of the table of FIG. 1, in the second state.
Figure 4:
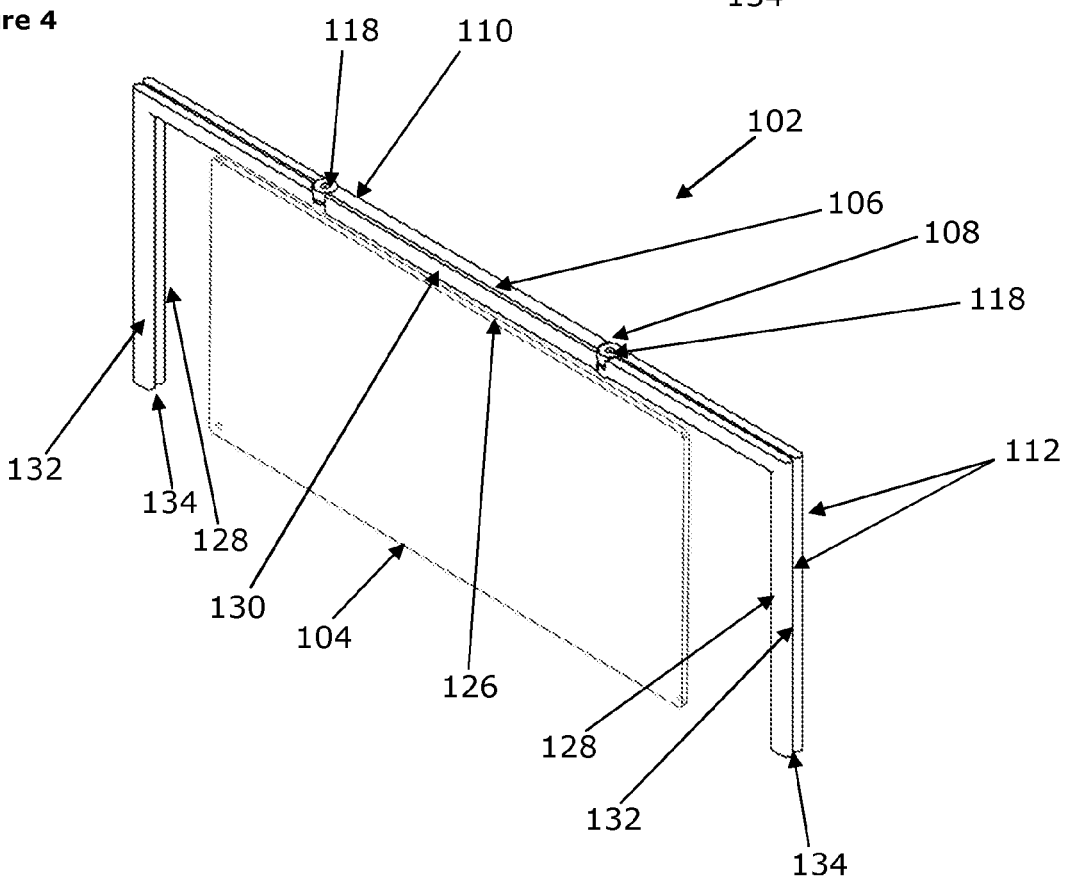
FIG. 4 depicts the table of Figure, including the table top, in the second state.

Now referring to FIGS. 3 and 4, the table is shown in its second state, or collapsed state, firstly with just the frame 102, and then also including the table top 104. As can be seen, in the second state, each pair of legs 112 are parallel both to one another and to the central strut 106, forming a generally U-shaped structure. In order that the U-shaped structure has a substantially uniform thickness, it is preferable for each pair of legs 112 to have substantially the same combined thickness as the thickness of the central strut 106. As such, in the present embodiment, each leg 112 has a thickness of approximately 50% that of the central strut 106.

The table top 104 is then both sized and shaped such that it fits into a space 124 defined by the bounds of the U-shaped structure. More specifically, the space 124 is defined by the underside 126 of the central strut 106, and the interior sides 128 of each leg 112. Again, to ensure that the table 100 occupies as small a volume as possible in its second state, it is further preferable for the table top 104 to have a thickness such that it fits within the two planes respectively defined by the two sides 130 of the central strut 106 and/or the two outside sides 132 of the pairs of legs 112, in the second state. A further bound on the space 124 can be defined by the plane defined by ground contacting portions 134 of each leg 112, when in the second state.

Thus, when in the second state, the table 100 may occupy a substantially cuboid volume with dimensions equal to the height of the legs 112, the combined length of the central strut 106 and legs 112, and thickness of the central strut 106, at a minimum. This results in the table 100 taking up a much smaller space than known tables, which do not have the ability to fold all legs or to position the table top within the bounds of the legs when not in use.

Although the depicted embodiment includes four hinged legs, it may also be possible to provide the present invention having two hinged legs, forming a tripodal frame when in the first state. In this case, the third, non-pivotally connected leg may be formed as one part with the central strut. In this manner, the small volume of the second state may be conserved without requiring a four-legged construction.

Despite the depicted embodiment including legs which have two distinct portions—the first portion extending horizontally and the second portion descending vertically, in use—it is also feasible for the legs to be shaped differently. For example, the legs may be arched or otherwise shaped such that they have a continuous profile, the only essential feature being that it is possible to fit the table top within the space, when in the collapsed state. Therefore, it may be a matter of design to shape the legs and table top in a way that they interact in the desired manner.

Although the table top is described as being formed as one, monolithic, piece. It may also be formed in multiple pieces, for example two pieces which are connected by a hinge, allowing them to be folded. In the case where the table top is formed of multiple pieces, it may be desirable to provide the table top with a thickness whereby in a folded configuration the table top still does not exceed the thickness of the central strut or legs. As such, the diminutive form factor may still be achieved, but with a larger table top than would otherwise be possible.

It is claimed:

1. A collapsible table comprising:

a central strut;

a pair of legs pivotally connected at or adjacent to a first end of the central strut;

a second pair of legs pivotally connected at or adjacent to a second end of the central strut; and a table top supportable by the central strut and legs;

wherein each pair of legs pivots about a common axis;

the collapsible table having a first state and a second state wherein, in the first state each pivotally connected leg is pivotally extended for supporting the table top perpendicular to the legs and in the second state the pivotally connected legs are pivotally retracted such that each pivotally connected leg is closer to parallel with the central strut, the table top fitting within a space defined on three sides by the central strut and legs.

2. A collapsible table as claimed in claim 1, whereby, in the second state, each pivotally connected leg is parallel or substantially parallel with the central strut.

3. A collapsible table as claimed in claim 1, wherein the pivotal connection of each pivotally connected leg allows rotation through an angle of at least 20 degrees, at least 30 degrees, or at least 45 degrees.

4. A collapsible table as claimed in claim 1, wherein the space is bounded by the central strut and at least two of the legs.

5. A collapsible table as claimed in claim 1, in which the space is bounded by a line joining two ground-contacting ends of the legs.

6. A collapsible table as claimed in claim 1, in which the space is bounded by a line joining points representing the extension of the legs beyond two ground-contacting ends of the legs by not more than 10% or 5% or 2.5% of the length of the legs from the central strut.

7. A collapsible table as claimed in claim 1, wherein each pivotally connected leg is connected to the central strut by a hinge.

8. A collapsible table as claimed in claim 7, wherein the table top is releasably attachable by way of at least one protrusion receivable in at least one corresponding depression, each protrusion being located on one of an underside of the table top and an upper side of the central strut or legs, each corresponding depression being located on the other of the underside of the table top and the upper side of the central strut or legs.

9. A collapsible table as claimed in claim 1, wherein each pivotally connected leg has a thickness equal to or less than 50% of the thickness of the central strut.

10. A collapsible table as claimed in claim 9, wherein one or more protrusions or legs depressions are located at or adjacent to an outermost extent of each leg.

11. A collapsible table as claimed in claim 1, wherein each pivotally connected leg has a first portion which pivotally extends in a common plane with the central strut and a second portion which extends in a direction perpendicular to the common plane.

12. A collapsible table as claimed in claim 1, wherein the table top is releasably attachable to the central strut or legs, in the first state.

13. A collapsible table as claimed in claim 1, wherein the table top is formed as one piece, the thickness of the table top being less than or equal to the thickness of the central strut.

14. A collapsible table as claimed in claim 1, wherein the table top is foldable, the thickness of the table top in a folded state being less than or equal to the thickness of the central strut.

15. A method of collapsing a table such that it occupies a smaller volume, the method comprising:

providing a collapsible table having:

a central strut, a pair of legs pivotally connected at or adjacent to a first end of the central strut, a second pair of legs pivotally connected at or adjacent to a second end of the central strut, and a table top supportable by the central strut and legs, wherein each pair of legs pivots about a common axis;

removing the table top from the table;

retracting the pivotally connected legs such that they are parallel to the central strut;

placing the table top within a space defined on three sides by the central strut and legs.

* * * * *